US006877736B2

(12) United States Patent
Chung

(10) Patent No.: US 6,877,736 B2
(45) Date of Patent: Apr. 12, 2005

(54) ROLLER APPARATUS FOR AUTOMATIC PAPER-FEEDING MECHANISM

(75) Inventor: Ming-Chieh Chung, Taipei (TW)

(73) Assignee: Teco Image Systems Co., Ltd., Taipei (TW)

( * ) Notice: Subject to any disclaimer, the term of this patent is extended or adjusted under 35 U.S.C. 154(b) by 225 days.

(21) Appl. No.: 10/269,058

(22) Filed: Oct. 11, 2002

(65) Prior Publication Data

US 2004/0070136 A1 Apr. 15, 2004

(51) Int. Cl.[7] ..... B65H 3/06
(52) U.S. Cl. ..... 271/118
(58) Field of Search ..... 271/10.04, 10.13, 271/10.11, 10.09, 118

(56) References Cited

U.S. PATENT DOCUMENTS

| | | | | | |
|---|---|---|---|---|---|
| 5,004,217 | A | * | 4/1991 | Kano et al. | 271/10.11 |
| 5,259,607 | A | * | 11/1993 | Hironori et al. | 271/10.13 |
| 5,386,982 | A | * | 2/1995 | Kawano | 271/10.04 |
| 5,624,109 | A | * | 4/1997 | Tanaka | 271/10.13 |
| 5,671,071 | A | * | 9/1997 | Ahn | 358/498 |
| 5,709,380 | A | * | 1/1998 | Petocchi et al. | 271/125 |
| 5,755,435 | A | * | 5/1998 | Fujiwara | 271/4.04 |
| 5,775,823 | A | * | 7/1998 | Bekki et al. | 400/629 |
| 5,882,002 | A | * | 3/1999 | Kamei et al. | 271/118 |
| 6,024,356 | A | * | 2/2000 | Tanaka et al. | 280/11.214 |
| 6,116,589 | A | * | 9/2000 | Bortolotti | 271/121 |
| 6,168,147 | B1 | * | 1/2001 | Nose et al. | 271/10.13 |
| 6,352,256 | B1 | * | 3/2002 | Hsieh | 271/110 |
| 6,390,463 | B1 | * | 5/2002 | Iwago | 271/118 |
| 6,431,541 | B2 | * | 8/2002 | Kuo et al. | 271/118 |
| 6,497,405 | B2 | * | 12/2002 | Yu et al. | 271/116 |
| 6,540,220 | B2 | * | 4/2003 | Kuo et al. | 271/118 |
| 6,616,136 | B1 | * | 9/2003 | Huang et al. | 271/10.13 |
| 6,666,446 | B2 | * | 12/2003 | Gaarder et al. | 271/10.04 |
| 2001/0015518 | A1 | * | 8/2001 | Yamamoto | 271/10.04 |

FOREIGN PATENT DOCUMENTS

| | | | | |
|---|---|---|---|---|
| JP | 4-32425 | * | 2/1992 | 271/118 |
| JP | 5-24684 | * | 2/1993 | 271/118 |
| JP | 5-301645 | * | 11/1993 | 271/117 |
| JP | 6-48595 | * | 2/1994 | 271/118 |
| JP | 6-72581 | * | 3/1994 | 271/114 |

* cited by examiner

*Primary Examiner*—Donald P. Walsh
*Assistant Examiner*—Mark Beauchaine
(74) *Attorney, Agent, or Firm*—Rosenberg, Klein & Lee

(57) ABSTRACT

A roller apparatus for an automatic paper-feeding mechanism has two parallel swing rods. The two swing rods are biased upwards by an elastic component. An upper roller is rotatably disposed at an end between the two swing rods. A paper-in roller is rotatably disposed at another end between the two swing rods. A first gear is disposed on a shaft of the upper roller. A second gear is disposed on a shaft of the paper-in roller. A first idle wheel rotatably disposed on one of the two swing rods is engaged between the first gear and the second gear. A second idle wheel differentially matched with the first idle wheel is disposed on a shaft of the first idle wheel. The second idle wheel engages a central gear rotatably disposed on the shaft of the upper roller.

9 Claims, 6 Drawing Sheets

ROLLER APPARATUS FOR AUTOMATIC PAPER-FEEDING MECHANISM

FIELD OF THE INVENTION

The present invention relates to an automatic paper-feeding mechanism and, more particularly, to an automatic paper-feeding mechanism, wherein a sun and planet wheel matched with an elastic component and a differential structure are exploited to effectively control the downward paper-leading action of a paper-in roller.

BACKGROUND OF THE INVENTION

A conventional automatic paper-feeding mechanism applied in machines like printers, scanners, copiers, or fax machines generally adopt the unidirectional torsion spring type or the electronic clutch type of control action for a paper-in roller thereof to accomplish the object of automatic paper feeding.

FIG. 1 shows a conventional unidirectional torsion spring type automatic paper-feeding mechanism, wherein an upper-tight-lower-loose unidirectional torsion spring 11*a* and an upper-loose-lower-tight unidirectional torsion spring 12*a* are slipped onto two ends of a pivot 10*a*, respectively. The two torsion springs 11*a* and 12*a* of opposite attributes are used to keep a constant friction force, and forward and reverse rotations of a motor are matched to control upward and downward paper-feeding actions of a paper-in roller 1*a*. However, because the two unidirectional torsion springs 11*a* and 12*a* are used to control the paper-feeding action of the paper-in roller 1*a*, when the unidirectional torsion spring type automatic paper-feeding mechanism feeds a paper in, the paper-in roller 1*a* cannot be lifted. Therefore, the friction between the paper-in roller 1*a* and the machine body will increase the load after the tail end of the paper leaves the paper-in roller 1*a*, hence causing jiggle of paper to affect its image quality.

FIG. 2 shows a conventional electronic clutch type automatic paper-feeding mechanism, wherein attraction and release actions of an electronic clutch 2*a* matched with containment of an elastic component 20*a* are exploited to control paper-leading actions like downward pressing or upward raising of a paper-in roller. However, the required cost of this type is too high. Moreover, because the control can only be accomplished with circuits, its internal circuit layout will be very complicated.

Furthermore, in a common automatic paper-feeding mechanism, special low-abrasion or abrasion-resistant material must be padded to avoid deterioration of image quality due to difference of load when the paper-in roller acts again after a paper is sent out. However, this special low-abrasion or abrasion-resistant material will further result in increase of the cost.

Accordingly, the above two conventional automatic paper-feeding mechanisms have drawbacks and inconvenience in practical use. The present invention aims to resolve the problems in the prior art.

SUMMARY OF THE INVENTION

The primary object of the present invention is to provide an automatic paper-feeding mechanism, wherein a sun and planet wheel matched with an elastic component and a differential structure are exploited to control the downward paper-leading action of a paper-in roller so as to alter continual downward pressing of the paper-in roller, hence replacing the conventional unidirectional torsion spring type or electronic clutch type automatic paper-feeding mechanism. Therefore, the paper-leading action of the paper-in roller can be effectively accomplished to ensure image quality in a simpler and cheaper way.

Another object of the present invention is to provide an automatic paper-feeding mechanism, whereby deterioration of the image quality of paper due to variation of load of a paper-in roller can be avoided. The underside of the paper-in roller is formed with a hollow configuration to solve the problem of variation of load and also the drawback of increased cost due to use of special low-abrasion or abrasion-resistant material.

To achieve the primary object, the present invention provides an automatic paper-feeding mechanism, which comprises two parallel swing rods. The two swing rods are biased upwards by an elastic component. An upper roller is rotatably disposed at an end between the two swing rods. A paper-in roller is rotatably disposed at another end between the two swing rods. A first gear is disposed at a side of a shaft of the upper roller. A second gear is disposed at the same side of a shaft of the paper-in roller. A first idle wheel rotatably disposed on one of the two swing rods is engaged between the first gear and the second gear. A second idle wheel differentially matched with the first idle wheel is disposed on a shaft of the first idle wheel. The second idle wheel engages a central gear rotatably disposed on the shaft of the upper roller. When the central gear is driven to rotate, because the second idle wheel makes a planetary motion on the central gear, the two swing rods can lead the paper-in roller to make the downward paper-leading action.

To achieve the other object of the present invention, the present invention provides an automatic paper-feeding mechanism, wherein a groove is formed below a paper-in roller. Thereby, deterioration of the image quality of paper due to variation of load can be avoided, and the cost can also be lowered.

The various objects and advantages of the present invention will be more readily understood from the following detailed description when read in conjunction with the appended drawings, in which:

DETAILED DESCRIPTION OF THE PREFERRED EMBODIMENTS

Figure 1:
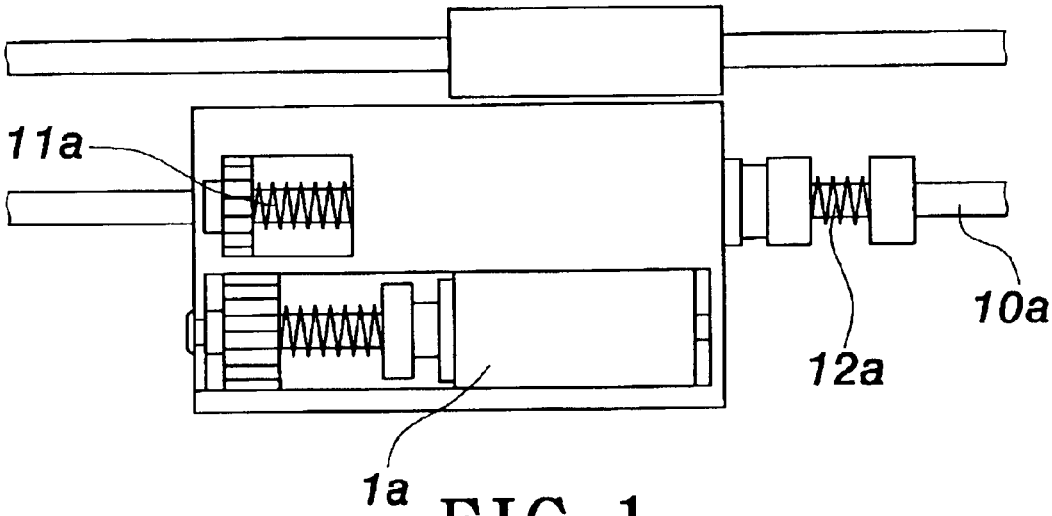
FIG. 1 PRIOR ART
FIG. 1 is a diagram of a conventional unidirectional torsion spring type automatic paper-feeding mechanism.
Figure 2:
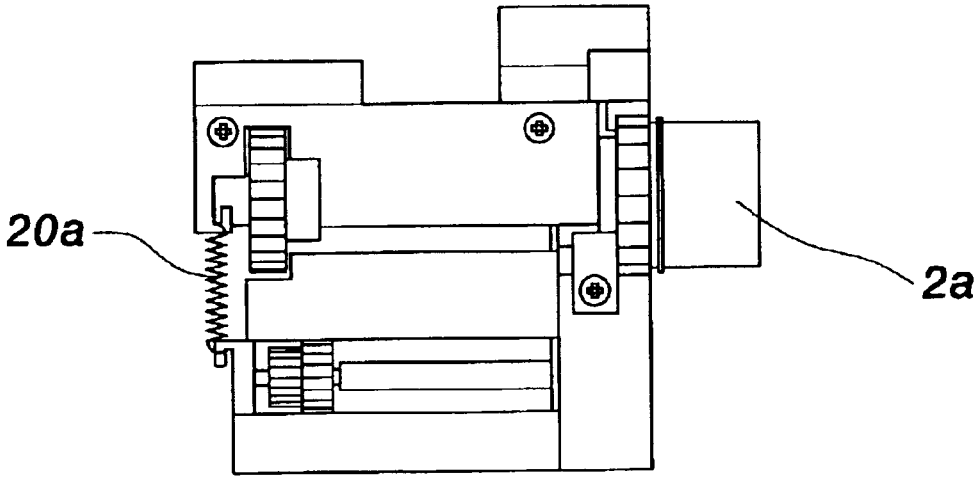
FIG. 2 PRIOR ART
FIG. 2 is a diagram of a conventional electronic clutch type automatic paper-feeding mechanism.
Figure 3:
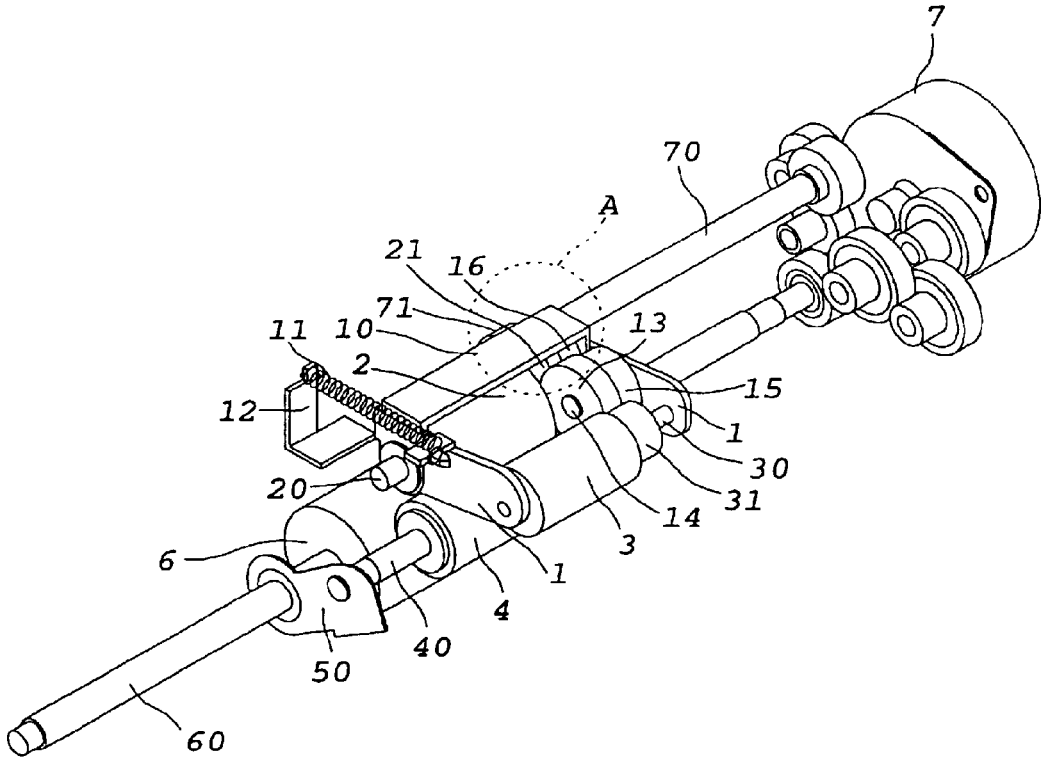
FIG. 3 is a perspective view an embodiment of the present invention.
Figure 4:
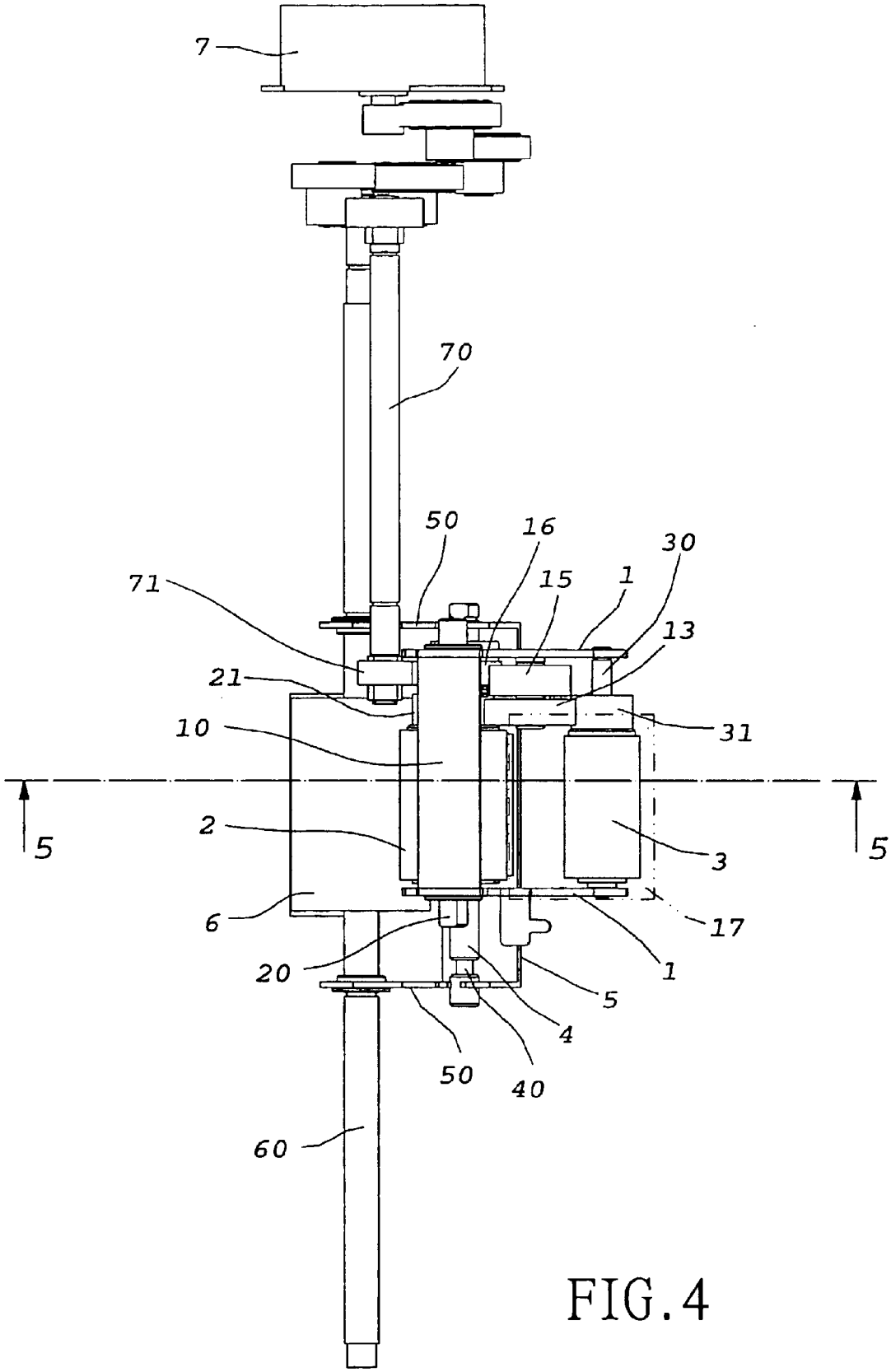
FIG. 4 is a top view of an embodiment the present invention.

As shown in FIGS. 3 and 4, the present invention provides an automatic paper-feeding mechanism, which comprises two parallel swing rods 1. Corresponding ends of the two swing rods 1 extend upwards to form an approximately inversely U-shaped portion with a connection portion 10, which extends between the two swing rods 1 to connect the two swing rods 1 together.

The two swing rods 1 are biased upwards by an elastic component 11. The elastic component 11 can be an extension spring. One end of the elastic component 11 is a fixed end fixed onto a base 12. The base 12 is connected with a shell body (not shown) of a machine such as a printer, a scanner, a copier, or a fax machine. Alternatively, the base is directly formed thereon. The other end of the elastic component 11 is connected to one of the two swing rods 1.

Figure 5:
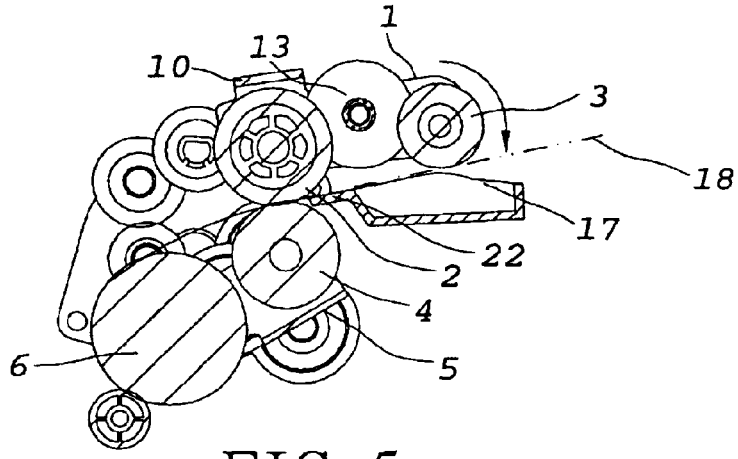
FIG. 5 is a cross-sectional action diagram along line 5—5 shown in FIG. 4.

An upper roller 2 is rotatably disposed on one end between the two swing rods 1. A paper-in roller 3 is rotatably disposed at another end between the two swing rods 1. A paper-separation sheet 22 is disposed below the upper roller 2, as shown in FIG. 5. A lower roller 4 is disposed at a downside corresponding to the upper roller 2. A shaft 40 of the lower roller 4 is rotatably disposed on two sidewalls 50 of a U-shaped rack 5. A shaft 60 of a turnaround roller 6 is rotatably disposed between the two sidewalls 50 of the U-shaped rack 5. The shaft 60 of the turnaround roller 6 is further disposed on a shell body (not shown) of a machine such as a printer, a scanner, a copier, or a fax machine.

Figure 3A:
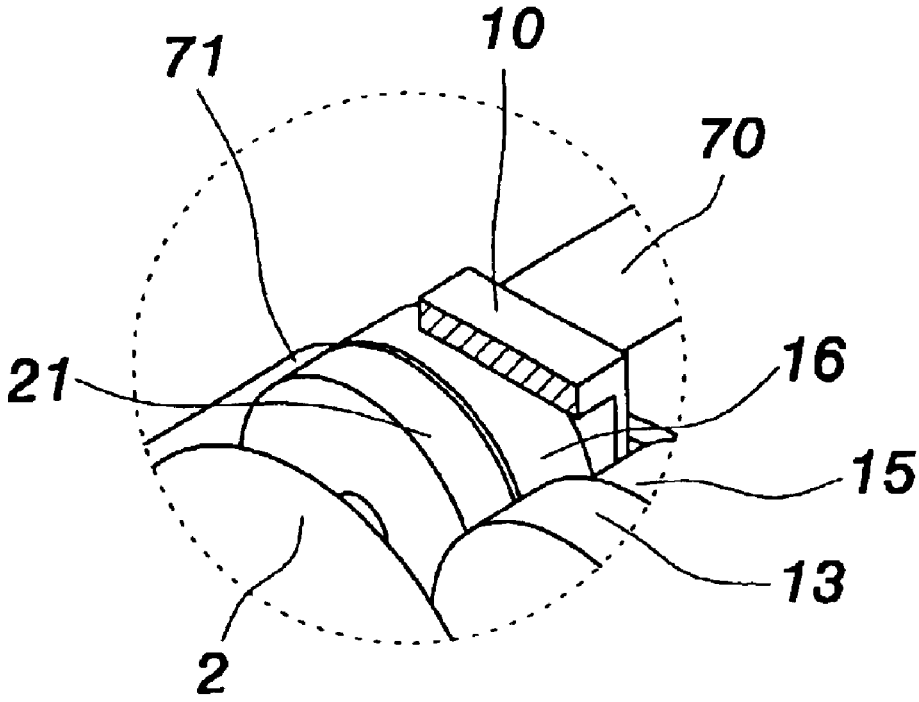
FIG. 3A is a partly enlarged view of part A in FIG. 3.

A first gear 21 is disposed at a side of the shaft 20 of the upper roller 2 (also referring to FIG. 3A). A second gear 31 is disposed at the same side of the shaft 30 of the paper-in roller 3. A first idle wheel 13 rotatably disposed on one of the two swing rods 1 is engaged between the first gear 21 and the second gear 31. A second idle wheel 15 is disposed on a shaft 14 of the first idle wheel 13.

Figure 3B:
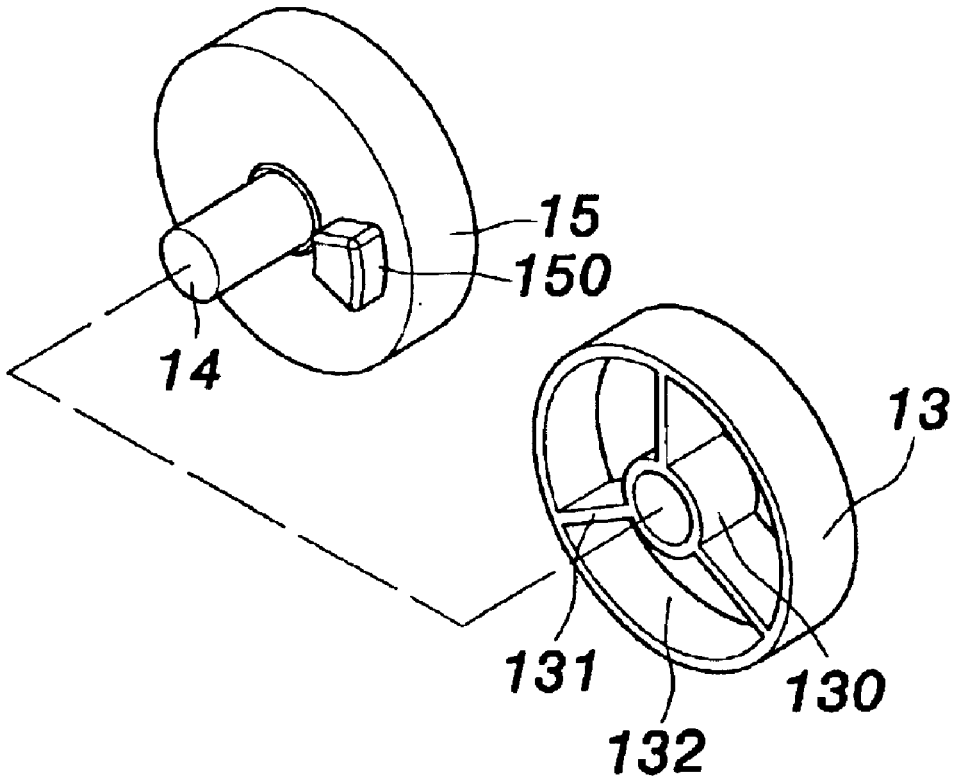
FIG. 3B is an exploded perspective view of a first idle wheel and a second idle wheel in an embodiment of the present invention.

The first idle wheel 13 is hollow (also referring to FIG. 3B). A sleeve shaft 130 is disposed at the center of the first idle wheel 13 to be rotatably disposed on the shaft 14 of the first idle wheel 13. Several ribs 131 are extended from the sleeve shaft 130 along the radial direction of the first idle wheel 13. A spacing 132 is formed between every adjacent two of the ribs 131. A bump 150 can be received in the spacing 132. The bump 150 is disposed on a left surface of the second idle wheel 15 so that differential match can be achieved between the first idle wheel 13 and the second idle wheel 15, hence forming a so-called differential structure.

The second idle wheel 15 engages a central gear 16 rotatably disposed on the shaft 20 of the upper roller 2. A drive motor 7 can lead an active shaft 70 to rotate by means of engaging transmission of the gear. An active gear 71 engaging the central gear 16 is disposed on the active shaft 70. Through rotation of the active gear 71, the above gears can be continuously driven to induce rolling and rotation of the upper roller 2 and the paper-in roller 3. Simultaneously, because the second idle wheel 15 makes planetary motions on the central gear 16, the two swing rods 1 can lead the paper-in roller 3 to make the downward paper-leading action.

A groove 17 is disposed below the paper-in roller 3 to make the downside of the paper-in roller 3 hollow.

Through the above structures, an automatic paper-feeding mechanism of the present invention is formed.

As shown in FIGS. 4 and 5, when the present invention starts, the upper roller 2 is subject to function of the paper-separation sheet 22 to generate a drag force. The drag force will be fed back to the second idle wheel 15, which then makes planetary motions on the central gear 16, hence letting the two swing rods 1 lead the paper-in roller 3 to make the downward paper-leading action. The paper-in roller 3 will thus draw in papers.

Figure 6:
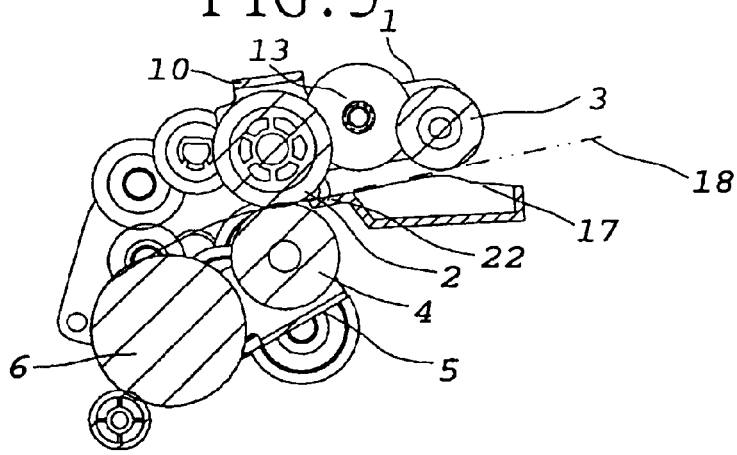
FIG. 6 is another cross-sectional action diagram along line 5—5 shown in FIG. 4.

As shown in FIGS. 4 and 6, when papers continually advance along a paper-in path 18, rolling of the upper roller 2 will draw in the papers and lead them to the turnaround roller 6 for printing, scanning, or faxing.

Figure 7:
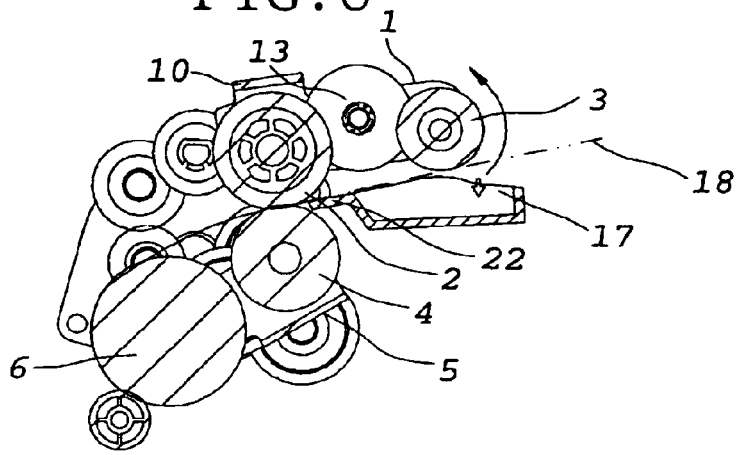
FIG. 7 is yet another cross-sectional action diagram along line 5—5 shown in FIG. 4.

As shown in FIGS. 4 and 7, when papers are led to the turnaround roller 6, because the tangential speed of the turnaround roller 6 is higher than that of the upper roller 2, speed will be transferred to the upper roller 2 through the papers. Difference of speed will thus be formed between first idle wheel 13 and the second idle wheel 15 because of matched transmission of the spacing 132 and the bump 150 (shown in FIG. 3B). Meanwhile, the two swing rods 1 will be biased by the elastic component 11 (shown in FIG. 3) to together take upwards the paper-in roller 3. When the papers leave the upper roller 2, the upper roller 2 and the second idle wheel 15 will stop rotating because there is no power. Until matched transmission of the spacing 132 and the bump 150, the two swing rods 1 will again lead the paper-in roller 3 to make the downward paper-leading action (thus, there is a fixed spacing between the papers). Moreover, because the downside of the paper-in roller 3 is hollow, there will be no variation of load to affect the image quality. The downward paper-leading action can thus be successfully and continually performed.

Finally, after the scanning work is finished, the drive motor 7 rotates in the reverse direction. Through the bias of the elastic component 11, the two swing rods 1 and the paper-in roller 3 are drawn upwards.

To sum up, the automatic paper-feeding mechanism of the present invention can effectively control the downward paper-leading action of the paper-in roller to replace the conventional unidirectional torsion spring type or electronic clutch type automatic paper-feeding mechanism. Moreover, the problem of deterioration of the image quality due to variation of load can be solved. The drawback of high cost can also be avoided.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. An automatic paper-feeding mechanism comprising two parallel swing rods, said two swing rods being biased upwards by an elastic component, an upper roller being rotatably disposed at an end between said two swing rods, a paper-in roller being rotatable disposed at another end between said two swing rods, a first gear being disposed on a shaft of said upper roller, a second gear being disposed on a shaft of said paper-in roller, a first idle wheel rotatably disposed on one of said two swing rods and being engaged between said first gear and said second gear, a second idle wheel differentially matched with said first idle wheel and being disposed on a shaft of said first idle wheel, said second idle wheel engaging a central gear rotatable disposed on said shaft of said upper roller.

2. The automatic paper-feeding mechanism as claimed in claim 1, wherein corresponding ends of said two swing rods extend upwards to a connection portion, extending between said two swing rods to connect them together.

3. The automatic paper-feeding mechanism as claimed in claim 2, wherein said corresponding ends of said swing rods and said connection portion form an inversely U-shaped portion.

4. The automatic paper-feeding mechanism as claimed in claim 1, wherein said elastic component is an extension spring.

5. The automatic paper-feeding mechanism as claimed in claim 1, wherein one end of said elastic component is a fixed end, and an opposing end of said elastic component is connected to one of said two swing rods.

6. The automatic paper-feeding mechanism as claimed in claim 5, wherein said fixed end of said elastic component is fixed onto a base.

7. The automatic paper-feeding mechanism as claimed in claim 1, wherein a corresponding lower roller is disposed below said upper roller.

8. The automatic paper-feeding mechanism as claimed in claim 1, wherein a groove is disposed below said paper-in roller.

9. The automatic paper-feeding mechanism as claimed in claim 1, wherein said first idle wheel is hollow and has a sleeve shaft disposed at a center thereof so as to be rotatable disposed on said shaft of said first idle wheel, a plurality of ribs are extended from said sleeve shaft along a radial direction of said first idle wheel, a spacing is formed between every adjacent two of said ribs, a bump is disposed at a surface of said second idle wheel, said bump is received in said spacing, and differential matching can thus be achieved between said first idle wheel and said second idle wheel.

* * * * *